United States Patent [19]

Love

[11] 4,399,806

[45] Aug. 23, 1983

[54] FIREPLACE DRAFT CONTROL

[76] Inventor: Samuel D. Love, 13510 Old Indian Head Rd., Brandywine, Md. 20613

[21] Appl. No.: 256,319

[22] Filed: Apr. 22, 1981

[51] Int. Cl.[3] ..... F24B 13/02

[52] U.S. Cl. ..... 126/143; 126/242; 126/288

[58] Field of Search ..... 126/120, 121, 143, 242, 126/289, 290, 288; 237/51

[56] References Cited

U.S. PATENT DOCUMENTS

| | | | |
|---|---|---|---|
| 2,470,430 | 6/1945 | Carter | 126/143 |
| 2,740,398 | 4/1956 | Collins | 126/143 |
| 2,819,711 | 1/1955 | Robinson | 126/143 |
| 2,863,443 | 7/1955 | Hoffman | 126/143 |
| 2,970,590 | 3/1957 | Fauser | 126/121 |
| 3,845,754 | 11/1974 | Wilkening | 126/121 |
| 3,976,048 | 8/1976 | Ashman, Jr. | 126/143 |
| 4,106,475 | 8/1978 | Mayes | 126/143 |
| 4,141,336 | 2/1979 | Fitch | 126/121 |
| 4,184,474 | 1/1980 | Pulliam et al. | 126/143 |
| 4,186,719 | 2/1980 | Dalsin | 126/143 |
| 4,213,445 | 7/1980 | Mayo | 126/143 |
| 4,248,205 | 2/1981 | Saunders | 126/143 |
| 4,248,206 | 2/1981 | Orthey, Jr. | 126/143 |

FOREIGN PATENT DOCUMENTS

| | | | |
|---|---|---|---|
| 781110 | 8/1957 | United Kingdom | 126/143 |

*Primary Examiner*—James C. Yeung

*Attorney, Agent, or Firm*—Parkhurst & Oliff

[57] ABSTRACT

A fireplace draft control useable in fireplaces having air inlets in either the floor or rear of the fireplace. The device comprises a base having punchout section which may cooperate with an air opening in the fireplace floor. A slidable plate is used for covering this opening. A hood, having openings to direct air to the fireplace grate, is attached to the base. A hinged plate is provided at the bottom rear portion of the hood to cooperate with an outside air source entering through the rear of the fireplace. A control rod is connectable to either the slidable plate or the hinged plate. A second punchout may be provided in the base to cooperate with a separate ash dump opening.

8 Claims, 5 Drawing Figures

FIREPLACE DRAFT CONTROL

BACKGROUND OF THE INVENTION

1. Field of the Invention

This invention relates to devices for controlling fireplace drafts, and more particularly, devices for controlling drafts in fireplaces having an outside source for combustion air.

2. Description of the Prior Art

Prior devices have not been capable of utilization with the several types of outside combustion air source fireplaces presently in use. These devices also do not efficiently deliver the outside combustion air to the fireplace grate.

SUMMARY OF THE INVENTION

It is an object of this invention to provide a draft control for fireplaces having outside combustion air sources which efficiently directs air into the fireplace grate.

It is a further object of this invention to provide a fireplace draft control which can be used with several different types of fireplaces.

It is a still further object of this invention to provide a fireplace draft control which is simple to construct.

BRIEF DISCUSSION OF THE DRAWINGS

DESCRIPTION OF THE PREFERRED EMBODIMENT

Figure 1:
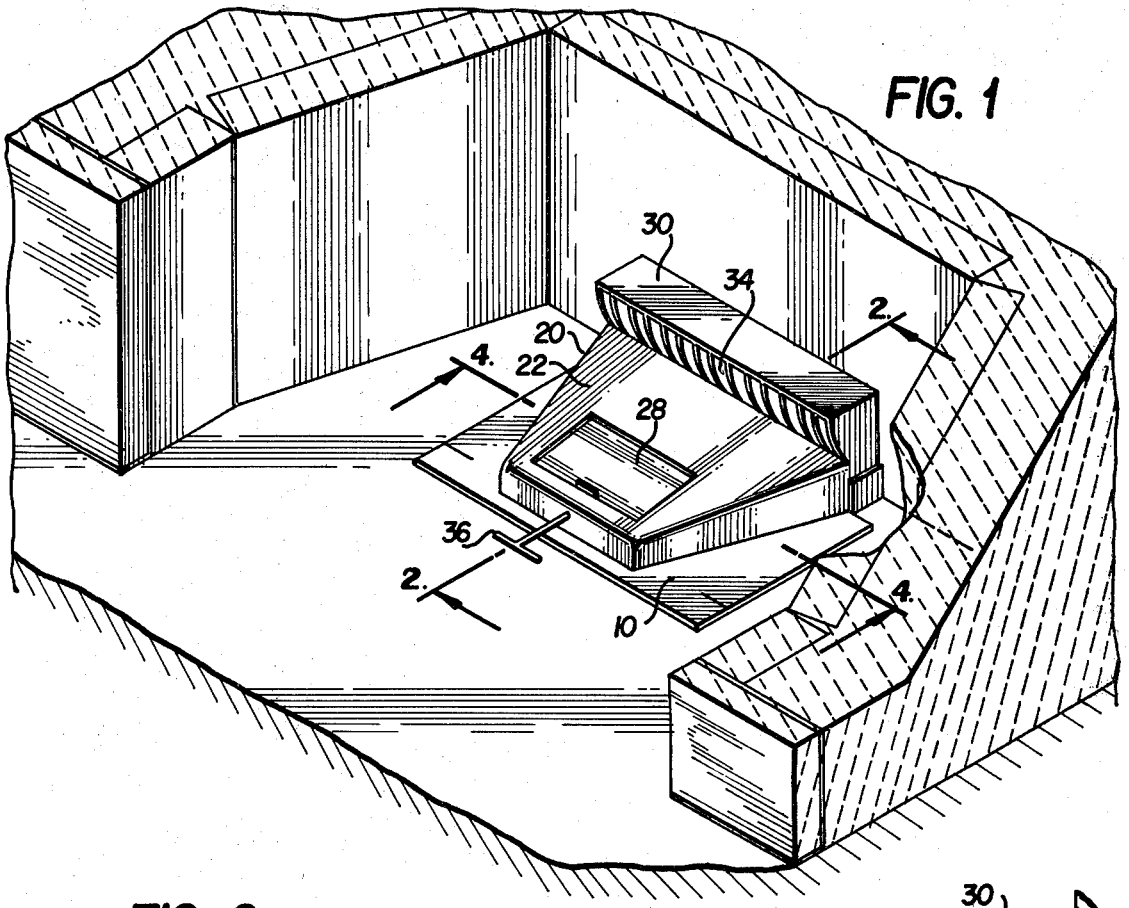
FIG. 1 shows a perspective view of the device of the present invention.

There are generally two types of fireplaces having outside air as a combustion source. In one type, the outside air enters from the floor of the fireplace. This type of fireplace is often provided with an ash disposal opening, which can either be the same opening as the air inlet or can be a separate opening. In the second type of fireplace, combustion air from the outside enters the fireplace through the rear wall of the fireplace. Providing an outside source of combustion air for the fireplace increases the efficiency of the fireplace since the front of the fireplace may then be effectively sealed, preventing the escape of warm room air up the fireplace chimney.

Referring to the drawings, the fireplace draft control of the present invention comprises a base 10 having first and second punchout sections 12 and 14. The first punchout section 12 is intended to cooperate with the air source opening on fireplaces having the opening in the fireplace floor. More specifically, it is preferred that part 13*a* of section 12 be folded up, while parts 13*b* be folded down to cooperate with the air source opening and secure the base with respect to the fireplace floor. Punchout section 14 is intended to cooperate with a separate ash dump, if one is present. Section 14 may be completely removable, or may cooperate with the opening in a manner similar to section 12. A slidable plate 18 is provided along with slide guides 16 so that either the first or second punchout section may be covered. Plate 18 is provided with a mounting member 17, as will be more fully described later. The use of slidable plate 18 allows for close control of the amount of combustion air entering the fireplace through first punchout section 12. Folded up part 13*a* can provide a convenient stop indicator for plate 18.

The draft control unit is also provided with a hood, generally indicated by numeral 20. This hood has an inclined front section 22 and a raised back portion 30. The front portion 22 may be provided with an opening 24 which is opened or closed by means of a second slidable plate 28, having a tab to facilitate movement, which cooperates with guides 26. This arrangement allows for convenient use of any ash dump facilities present in the fireplace, since slidable plate 28 may be moved to allow ashes to be moved to the interior of the device and then into the ash dump. It is particularly advantageous if opening 24 is located directly above second punchout 14, as ashes then would fall directly into the ash dump.

Figure 3:
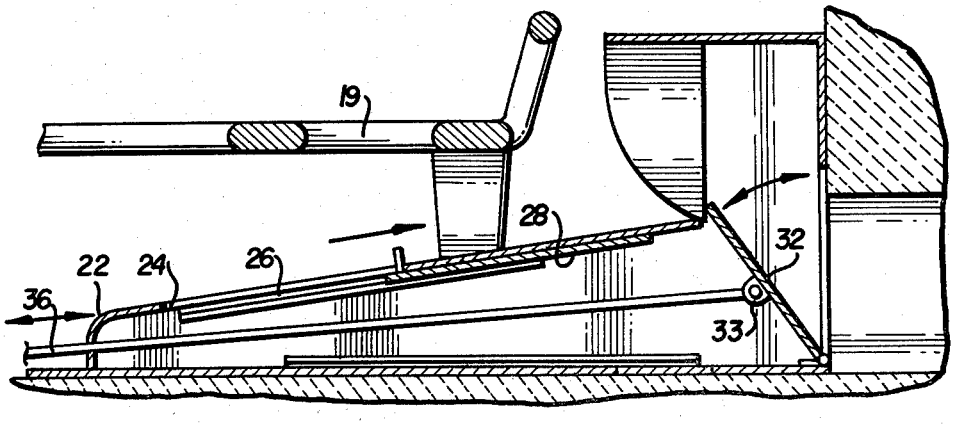
FIG. 3 shows a sectional side view of a second method of using the device of the present invention.
Figure 4:
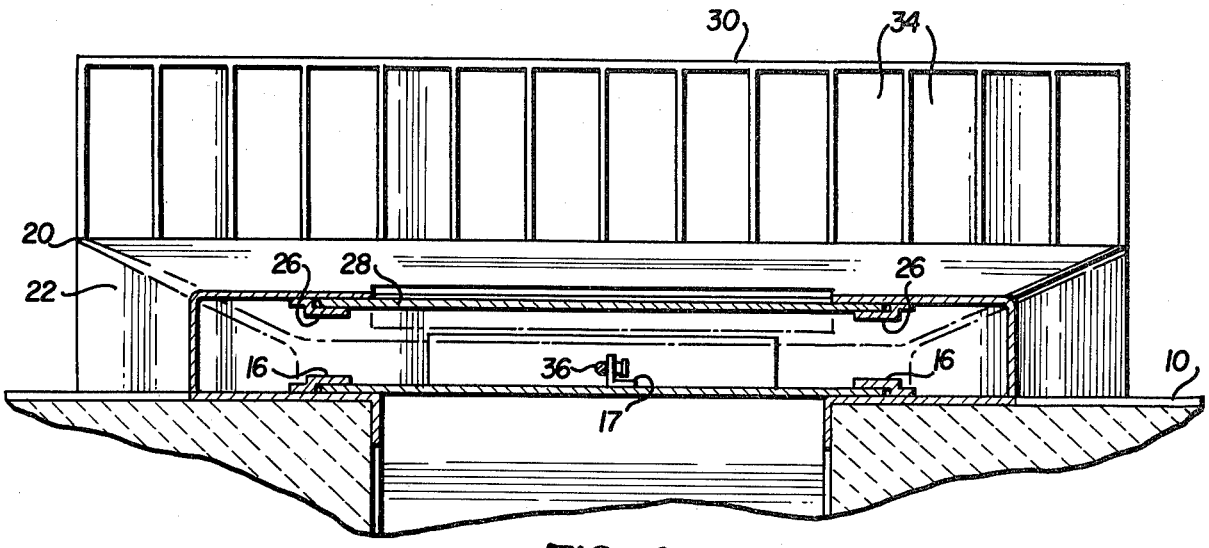
FIG. 4 shows a sectional front view taken along line 4—4 of FIG. 1.
Figure 5:
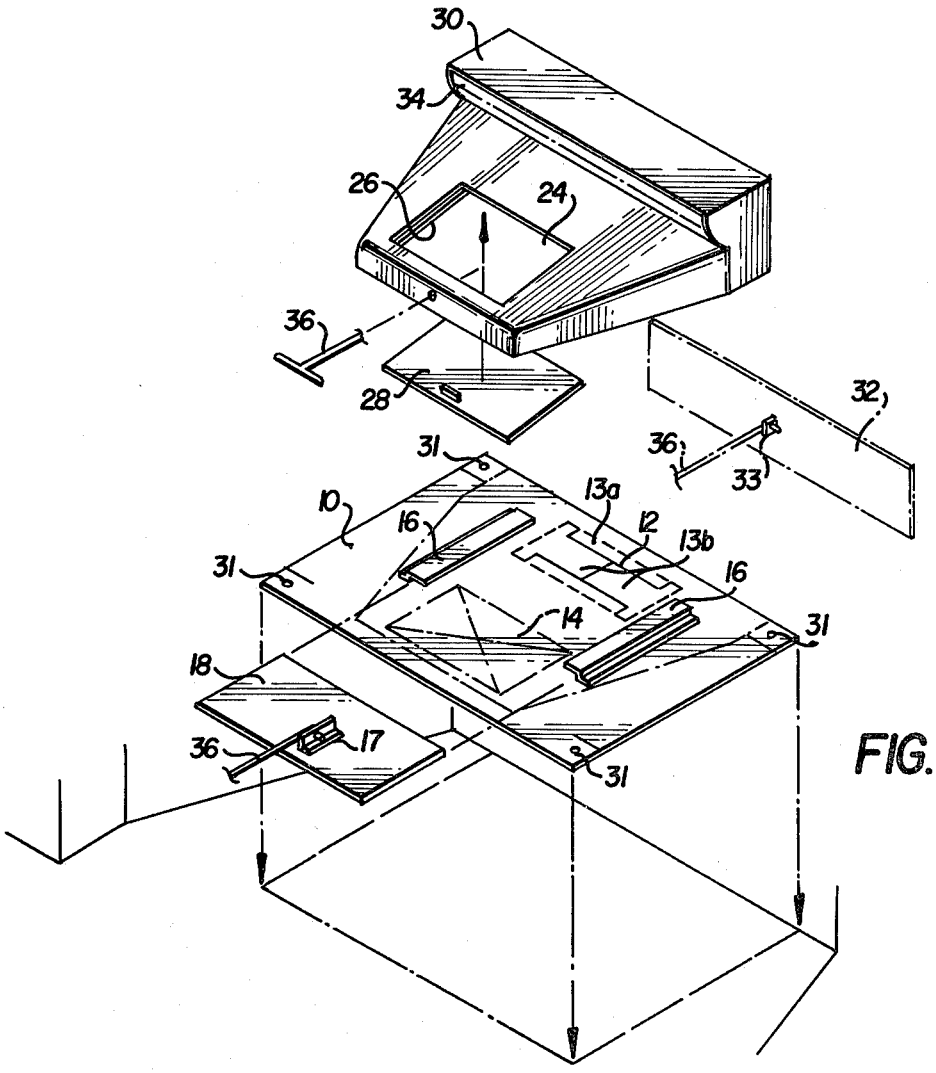
FIG. 5 shows an exploded view of the present invention.

Raised back portion 30 is provided with air outlets 34 through which the outside air finally enters the fireplace. For fireplaces having outside air entering through the rear wall of the fireplace, for example as shown in FIG. 3, back portion 30 is provided with a hinged back plate 32, hinged at the bottom rear portion, having a mounting tab 33. It is intended that hinged plate 32 be capable of isolating air outlets 34 from the front section of the hood 22. This increases the efficiency of air flow into the fireplace. With fireplaces having an opening in the floor, air enters through opening 12, flows to the back portion 30 and out through openings 34. It may be desirable to provide a screen for cooperating with the opening in the fireplace, to prevent the entry of undesired outside material into the draft control and fireplace.

Figure 2:
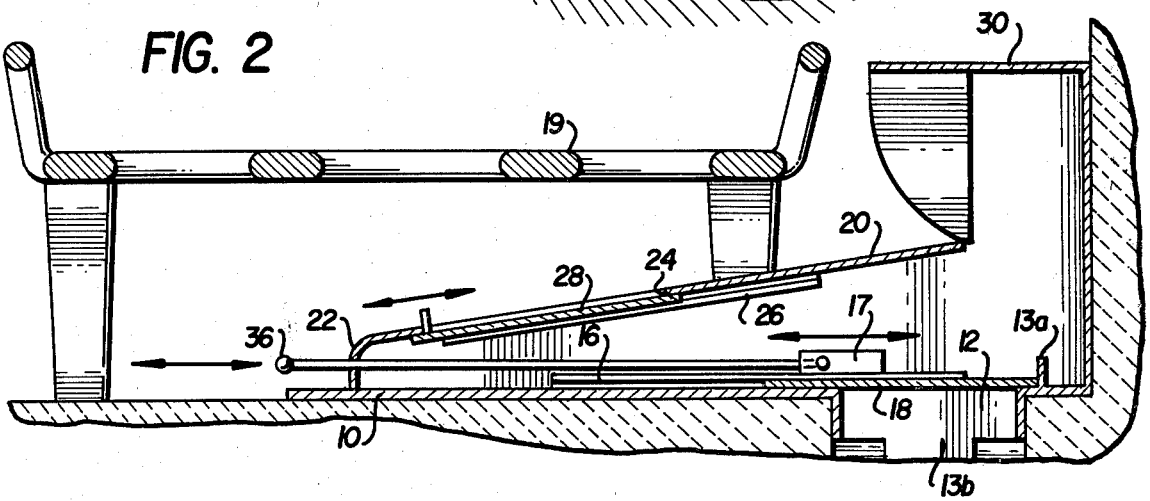
FIG. 2 shows a sectional side view taken along line 2—2 of FIG. 1, showing one method of using the device of the present invention.

If it is clear that the device will not be used with fireplaces having an air source at the fireplace rear, the hinged back plate 32 may be eliminated for ease of manufacture, and the raised back portion 30 may be of unitary construction, as shown in FIG. 2. Similarly, it is clear that if the device will only be used with fireplaces having an air source at the rear, the punchouts, slidable plate and slide guides may be eliminated, and a solid, flat base provided. It is preferred, however, for versatility that provision for both the hinged back plate and slidable plate be made.

The amount of air entering the fireplace is easily controlled by means of control rod 36, which is optionally attached either to slidable plate 18 through mounting member 17 or to hinged plate 32 through mounting tab 33. The positioning of outlets 34 allows for efficient delivery of combustion air to the fireplace grate. The base is also provided with tabs 31 which may be folded up and attached to hood 20 by means of screws (or other suitable means) to hold the hood in contact with the base. Two sets of such tabs are provided in case, because of the location of the holes in the fireplace floor, it would be desirable that the base be rotated 180° to most conveniently fit the location of the holes. It is contemplated that the fireplace draft control described will sit substantially behind and extend underneath the grate 19 of the fireplace, as shown in FIGS. 2 and 3, without extending past the outer wall of the fireplace.

What is claimed is:

1. A fireplace draft control comprising:

a base for resting on a fireplace floor, having a first punchout section for cooperating with an air source in the fireplace floor, and a first movable plate for covering and uncovering said first punchout section;

a hood attached to said base, said hood having a front section, a rear section of greater height than that of said front section, said rear section having an air outlet opening directed substantially over said front section, and a second movable plate located at the lower rear portion of said hood, said hood provided with means for isolating said air outlet opening from said front section while allowing air to flow to said air outlet opening; and a control member capable of being connected to either said first or second plate, extending outwardly from the front section of said hood.

2. A fireplace draft control, comprising:

a base for resting on a fireplace floor, having a first punchout section for cooperating with an air source in the fireplace floor, a first slidable plate for covering and uncovering said first punchout section, and first guide means cooperating with said first slidable plate;

a hood attached to said base, having a front section, a rear section of height greater than that of said front section, said rear section having an air outlet opening directed substantially over said front section and a hinged plate located at the lower rear portion of said hood, said hood provided with means for isolating said air outlet opening from said front section while allowing air to flow to said air outlet opening; and a control member capable of being connected to either said hinged plate or said first slidable plate, extending outwardly from the front section of said hood.

3. A fireplace draft control comprising:

a base having a first punchout section for cooperating with an air source in a fireplace floor, a first slidable plate for covering and uncovering said first punchout section, and first guide means cooperating with said first slidable plate;

a hood attached to said base, having a front section, said front section having an opening, a second slidable plate for covering and uncovering said opening, and second guide means cooperating with said second slidable plate; a rear section of greater height than that of said front section having an air outlet opening and a hinged plate located at the lower rear portion of said hood, capable of isolating said air outlet opening from said front section; and a control member capable of being connected to either said hinged plate or said first slidable plate, extending outwardly from the front section of said hood.

4. A fireplace draft control comprising:

a base having a first punchout section for cooperating with an air source in a fireplace floor, a first slidable plate for covering and uncovering said first punchout section, first guide means cooperating with said first slidable plate, and a second punchout section for cooperating with an ash dump;

a hood attached to said base, having a front section, said front section having an opening, a second slidable plate for covering and uncovering said opening, and second guide means cooperating with said second slidable plate; a rear section of greater height than that of said front section having an air outlet opening and a hinged plate located at the lower rear portion of said hood, capable of isolating said air outlet opening from said front section; and a control member capable of being connected to either said hinged plate or said first slidable plate, extending outwardly from the front of said hood.

5. A fireplace draft control as claimed in claim 4, wherein said second punchout is located directly under the opening in said hood.

6. A fireplace draft control, comprising:

a base for resting on a fireplace floor, having a first punchout section for cooperating with an air source in a fireplace floor, a slidable plate for covering and uncovering said first punchout section, first guide means cooperating with said first slidable plate and a second punchout section located forwardly of said punchout section, said second punchout section being capable of cooperating with an ash dump;

a hood attached to said base having a front section, and a rear section of height greater than that of said front section, said front section directing combustion air to said rear section, said rear section having an air outlet opening for directing air to the rear of a fireplace grate; and a control member attached to said first slidable plate, extending outwardly from the front section of said hood.

7. A fireplace draft control, comprising:

a base for resting on a fireplace floor;

a hood attached to said base, comprising a front section having a top with an opening, and a rear section of height greater than that of said front section, said rear section having an air outlet opening and a hinged plate located at the lower rear portion of said hood, said hood provided with means for isolating said air outlet opening from said front section of said hood while allowing air from an air source to flow to said air outlet opening; and a control member connected to said hinged plate, extending outwardly from the front of said hood; and means for covering and uncovering the opening in said front section.

8. A fireplace draft control as claimed in claim 7, wherein said means for covering and uncovering comprise a slidable plate and guide means for said slidable plate.

* * * * *